United States Patent [19]

Lewis et al.

[11] Patent Number: 4,572,279

[45] Date of Patent: Feb. 25, 1986

[54] ELECTROMAGNETIC SHAPING OF THIN RIBBON CONDUCTOR STRIP CAST ONTO A CHILL WHEEL

[75] Inventors: Brian G. Lewis, Branford; John V. Patton, New Haven, both of Conn.

[73] Assignee: Olin Corporation, New Haven, Conn.

[21] Appl. No.: 584,281

[22] Filed: Feb. 27, 1984

[51] Int. Cl.[4] ..... B22D 11/00

[52] U.S. Cl. ..... 164/463; 164/467; 164/423

[58] Field of Search ..... 164/423, 463, 467, 503

[56] References Cited

U.S. PATENT DOCUMENTS

| | | | |
|---|---|---|---|
| 2,686,864 | 8/1954 | Wroughton et al. | 164/498 |
| 3,096,158 | 7/1963 | Gaulé et al. | 422/246 |
| 3,862,658 | 1/1975 | Bedell | 164/87 |
| 4,150,706 | 4/1979 | Reiniche et al. | 164/49 |
| 4,157,729 | 6/1979 | Patton et al. | 164/423 |
| 4,262,734 | 4/1981 | Liebermann | 164/423 |
| 4,339,508 | 7/1982 | Tsuya et al. | 164/429 |
| 4,373,571 | 2/1983 | Yarwood et al. | 164/467 |
| 4,381,233 | 4/1983 | Adachi et al. | 204/242 |
| 4,419,177 | 12/1983 | Pryor et al. | 164/469 |
| 4,448,236 | 5/1984 | Kimura | 164/463 |
| 4,479,528 | 10/1984 | Maringer | 164/423 |
| 4,484,614 | 11/1984 | Maringer | 164/463 |

FOREIGN PATENT DOCUMENTS

| | | |
|---|---|---|
| 62621 | 1/1982 | Japan . |
| 57-1546 | 1/1982 | Japan . |
| 56-23596 | 8/1982 | Japan . |

*Primary Examiner*—Francis S. Husar
*Assistant Examiner*—Jorji M. Griffin
*Attorney, Agent, or Firm*—Howard M. Cohn; Barry L. Kelmachter; Paul Weinstein

[57] ABSTRACT

An apparatus and process for producing thin ribbon of semiconductor material. A device is provided for feeding the material onto a moving chill block. A first electromagnetic field is generated to heat the material in the solid condition into a molten drop and then to shape the molten drop into a thin ribbon shape prior to the contact of the material with the chill block.

38 Claims, 10 Drawing Figures

ELECTROMAGNETIC SHAPING OF THIN RIBBON CONDUCTOR STRIP CAST ONTO A CHILL WHEEL

This application relates to U.S. application Ser. No. 584,222 entitled "Electromagnetic Shaping of Thin Semiconductor Ribbon Strip Cast Onto a Chill Block" by Brian G. Lewis, filed Feb. 27, 1984.

While the invention is subject to a wide range of applications, it is especially suited for producing high quality, thin ribbon strip at a relatively slow casting rate and will be particularly described in that connection.

In conventional chill-block spinning, a metal jet impinges on a cold moving surface where it is reshaped and solidified. Chill blocks of various geometries, including concave and convex discs, cylinders and drums have been employed in the prior art. A typical example of this technique is disclosed in U.S. Pat. No. 4,339,508 to Tsuya et al. which discloses a method for manufacturing a thin and flexible ribbon of super conductor material.

Generally, chill block casting requires rapid quenching techniques and high casting rates. For example, In U.S. Pat. No. 4,262,734 to Liebermann, the substrate wheel rotates at a linear velocity of between 10 meters/-second to 50 meters/second. Although this high speed may be required for rapid solidification associated with high speed casting, it generally provides microstructure which is unacceptable for certain applications contemplated by the present invention.

A different approach for depositing a molten alloy on a chill wheel is disclosed in Japanese Application No. 55-75329 entitled "Production Of Quickly Solidified Material". The molten material is conducted "to the surface of a rotary cooling body by means of electromagnetic force". By quickly cooling the molten alloy on the body, a thin, continuous strip is produced. The electromagnetic force is generated by an electromagnetic pump which is quite different from the present invention where the molten material is delivered by gravity feed or pressure and the electromagnetic forces shape the melt on the chill wheel.

During the cooling of the molten material on the chill wheel, it is desirable to shape the liquid melt as required. In the past this has been done by techniques such as shaping the wheel into different configurations and prolonging the contact of the melt on the wheel as disclosed in U.S. Pat. No. 3,862,658 to Bedell. In that patent, the period of contact may be prolonged by use of such devices as gas jets, moving belts or rotating wheels.

Another technique for shaping the melt is disclosed in Japanese Patent Application No. 56-23596 entitled "Production Of Solid Solution Quick Cooling Material". A corona discharge is generated between an electrode and the injection material on the surface of a cooling roll. The result is a quick-cooled material of a thin shape.

A technique of shaping the melt prior to contact with the chill wheel is disclosed in U.S. Pat. No. 4,150,706 to Reiniche et al. A jet of liquid metal is given a reciprocating movement in various ways so that the final strip has an undulated shape. For example, the jet is arranged to pass through a constant magnetic field which induces a variable alternating force on the jet prior to its contact with the chill wheel. This differs from the present invention where the final shaping of the molten material occurs on the surface of the chill wheel. Further, the patent does not disclose both melting and shaping the molten material prior to its contact with the chill wheel.

The quality of the molten metal being shaped can be controlled as disclosed in Japanese Patent Application No. 56-62621 entitled "Production Of Metallic Plate". The purpose is "To increase viscosity and to improve homogenization and surface characteristic in the case of bringing molten metal into contact with a moving heat transmitting surface and cooling the same quickly by forming a magnetic field intersecting orthogonally with the advancing direction thereof with said metal." The permanent magnetic field disclosed in this patent functions in a completely different manner than the electromagnetic shaping field associated with the chill block of the present invention.

The present invention is specifically directed to an electromagnetic generating device which both melts a solid rod of material such as silicon into a pendant drop and then shapes the drop into the desired shape prior to its contact with a chill block. The prior art does not teach or suggest the use of an electromagnetic flux field for both melting and shaping material prior to its contact with a chill block. For example, U.S. Pat. No. 2,686,864 to Wroughton et al. discloses in FIG. 23 that the material may be heated by coils 23f and then shaped by coils 22f. This concept is similar to that disclosed in U.S. Pat. No. 4,419,177 to Pryor et al.

The present invention has particular application to forming semiconductor materials such as silicon on a chill block. The prior art, such as U.S. Pat. No. 4,381,233 to Adachi et al., discloses forming a silicon type material on a chill wheel. However, there is no disclosure or suggestion of melting or forming the material with an electromagnetic flux flield prior to its contacting the chill wheel surface in particular as set out in the present invention.

It is a problem underlying the present invention to provide a casting technique where relatively slow solidification rates are possible and the shape of the final thin strip can be regulated.

It is an advantage of the present invention to provide an apparatus for producing thin ribbon strip from molten material which obviates one or more of the limitations and disadvantages of the described prior arrangements.

It is a further advantage of the present invention to provide an apparatus for producing a thin ribbon strip which allows for relatively slow solidification rates.

It is a yet further advantage of the present invention to provide an apparatus for producing a thin ribbon strip wherein electromagnetic shaping of the melt occurs on the chill wheel.

It is a still further advantage of the present invention to provide an apparatus for producing a thin ribbon strip wherein an electromagnetic flux field heats and shapes the material prior to contact with a chill block.

It is a yet further advantage of the present invention to provide an apparatus for producing a thin ribbon strip which is relatively inexpensive to manufacture.

Accordingly, there has been provided an apparatus and process for producing a thin strip from molten material. Molten material is deposited onto a first location of a moving chill block. A thin ribbon strip is pulled from a second location on the chill block downstream from the first location. A magnetic field is produced adjacent the chill block for shaping the deposited molten material on the chill block into the thin ribbon strip.

A second embodiment of the present invention is directed to an apparatus and process for producing thin ribbon of semiconductor material from a feed rod of solid material. As the feed rod is fed towards a moving chill block, the solid material is heated to form a molten pendant drop adjacent a chill block. An electromagnetic flux field generating device heats the solid material into a melt and shapes the molten drop prior to its contact with the chill block.

The invention and further developments of the invention are now elucidated by means of the preferred embodiments shown in the drawings.

Figure 10:
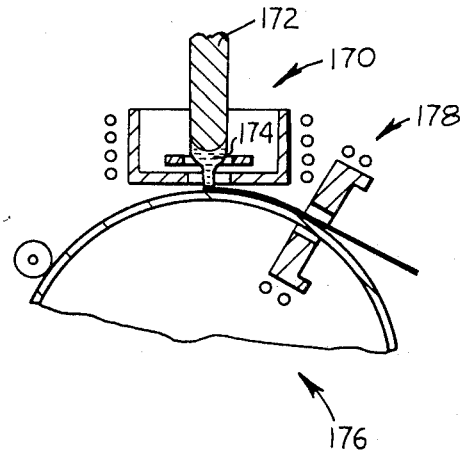
Figure 9:
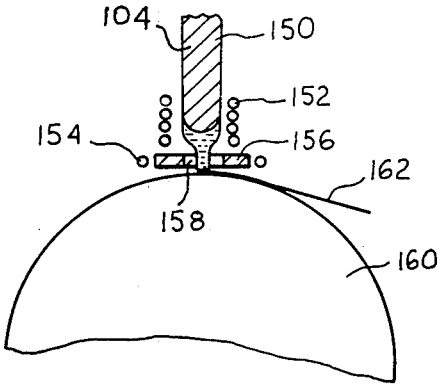

FIG. 9 is a schematic representation of an embodiment of the present invention wherein separate electromagnetic fields heat and shape the molten material; and FIG. 10 is a schematic representation of an embodiment of the present invention wherein separate electromagnetic fields melt and shape a material for delivery onto a chill block where further electromagnetic containment defines its final dimensions.

Figure 1:
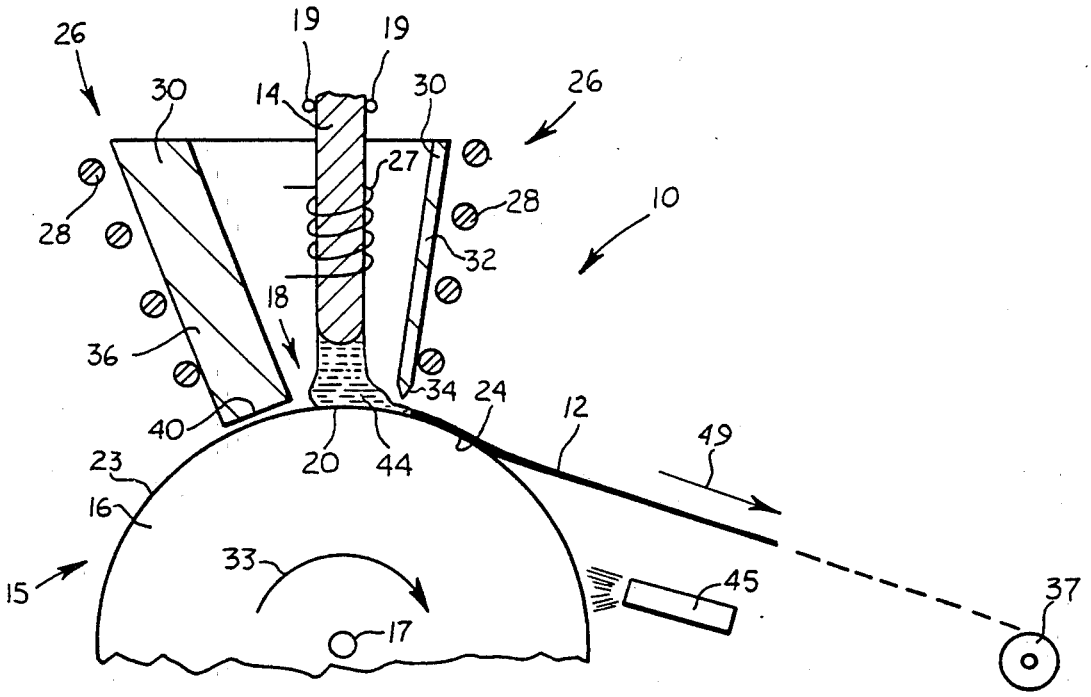
FIG. 1 is a schematic representation of a chill wheel casting apparatus in accordance with the present invention.

Referring to FIG. 1, there is illustrated an apparatus 10 for producing a thin ribbon strip 12 from a melt of material 14. The apparatus includes a chill block 15 and a device 18 for depositing the molten material onto the chill block 15. A magnetic field producing device 26 adjacent the chill wheel shapes the deposited molten material on the chill wheel into the thin ribbon strip.

The present invention is particularly directed to providing efficient and controllable heat removal from the shaping region using a solid chill block or wheel. As will be further elaborated below, the apparatus of this invention is a novel combination of electromagnetic shaping and chill casting. FIG. 1 is a schematic diagram showing an embodiment for casting a semiconductor ribbon or strip, such as a silicon ribbon. A desired material 14 in a molten condition is fed onto or extracted by the moving chill wheel 16. As the molten material, e.g. silicon, passes through an electromagnetic field generated by a coil 28 and a flux concentrator 30, shaping is provided by the electromagnetic field interaction and solidification occurs by heat extraction through the wheel. The control of the solidification has particular advantages in producing materials for solar cell and electronic applications. These applications frequently require a large grained material with through section grain growth. Ideally, a single crystal material is formed by initially seeding the ribbon.

There are two particular advantages of the apparatus and process which are disclosed in the present invention. First, the latent heat in the molten material and the induced heat, i.e. from the electromagnetic containment force, can both be extracted by the chill wheel. Second, the rate of heat removal can be controlled by the speed of the chill wheel, the selecting of the wheel material, and/or the wheel temperature. Each of these variables are selected in accordance with the particular material being cast as well as the final shape and crystal structure desired.

The chill wheel may be of any desired diameter and may be rotated about its center 17 at a peripheral speed of about 10 centimeters/minute to about 30 centimeters/minute and preferably about 15 centimeters/minute to about 25 centimeters/minute. The wheel may be made of any material which is stable during contact with the melt such as, for example, steel or copper. Also, the wheel may be formed of a material which is chrome plated or provided with a ceramic coating.

Figure 3:
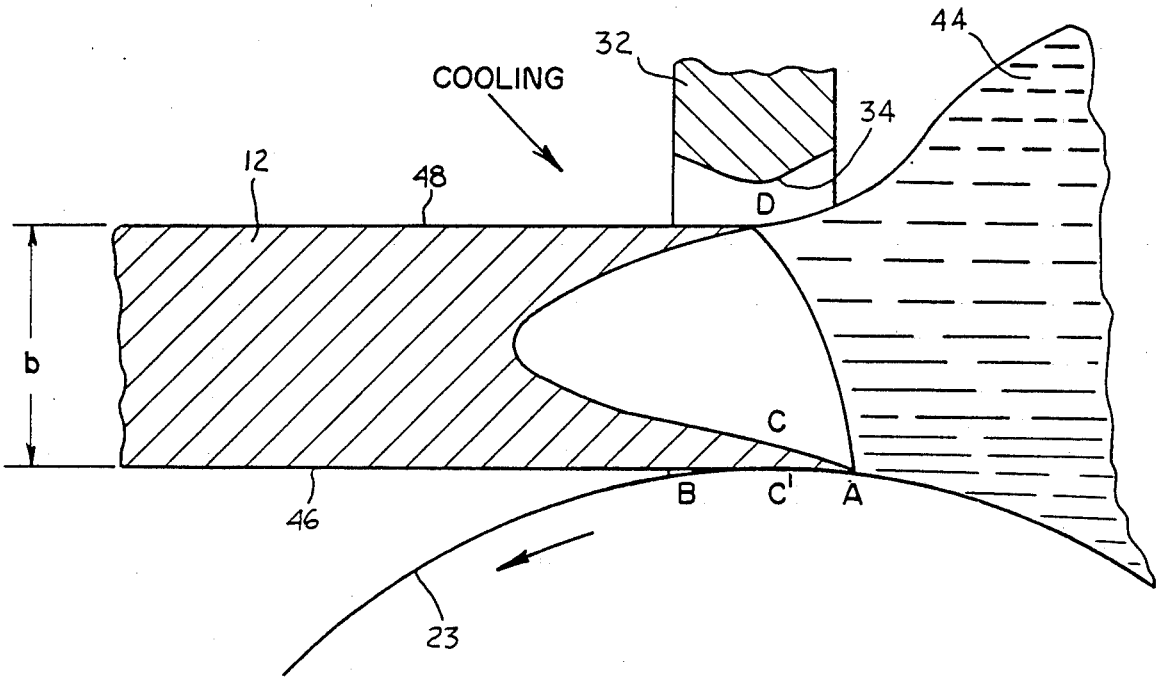
FIG. 3 is a cross-sectional side view of the solidification of molten material.
Figure 2:
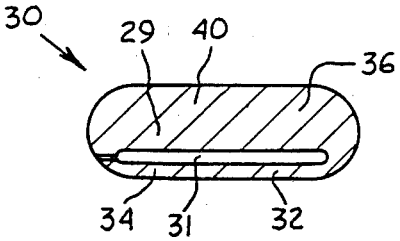
FIG. 2 is a cross-sectional view of a flux concentrator in accordance with the present invention.

The melt may be applied to the surface 23 of the wheel by any conventional technique such as with a feed rod as shown or through a tube with a nozzle of desired diameter at one end. The feed rod may be melted by any conventional means such as a heating coil with or without a susceptor like an R-F coil 27 around the feedstock, resistive heating, or a direct energy source. A number of important differences distinguish the present invention from the prior art techniques associated with chill block casting. One particular difference relates to the electromagnetic shaping performed by the magnetic field producing device 26. As shown in FIGS. 1 and 2, this device may comprise a first inductor coil 28 disposed about a first flux concentrator 30. The side walls of concentrator 30 flares outward from its bottom or base surface 29 which is disposed adjacent the chill wheel. A substantially oval slot 31 through which the molten material passes onto the wheel is formed in the base 29. Upstream and downstream side walls 36 and 32, respectively, flare outward from the bottom surface 29 away from the chill wheel. The thinner side wall 32, downstream from the point of melt deposition, has a bottom surface 34 which may be slightly curved as best seen in FIG. 3. By contrast, opposite upstream wall 36 may be substantially thicker than side wall 32 and have a substantially flat bottom surface 40. As in any typical concentrator, the electromagnetic field from the inductor coil 28 induces a current in the body of the concentrator which flows around the slot 31, i.e. the suction of least electrical resistance. The disclosed flux concentrator is shaped so that the magnetically derived force dams up the molten material behind the downstream curved surface 34 and presses the molten material into a strip of desired thickness 12 under the side wall 32. The upstream side wall 36 provides very good capacitive coupling between its bottom surface 40 and the surface of the chill wheel 16. These features will be further elaborated on hereinbelow. It is also within the terms of the present invention to substitute a concentrator of any desired configuration in accordance with the principles set forth in U.S. Pat. Nos. 3,096,158 to Gaule et al. and 4,373,571 to Yarwood et al. Once the strip is formed and partially solidified on the chill wheel, it is taken up from location 24 by any desired means, such as a coiling wheel 37.

To more fully understand the present invention, an analysis of the process by which the silicon feed rod 14 is converted to a thin strip 12 follows. First, the material 14 may be melted into a drop of melt 44 and deposited at a first location 20 of the chill wheel 16. The melting may be accomplished by any desired conventional technique and preferably without contact between the feed rod and the heating device so that purity of the melt may be maintained. As the feed rod becomes very hot or molten, the electromagnetic field from the coils 28 couples with the material and further heats the material. The drop of molten material 44, deposited upon the surface 23, is primarily held together by surface tension and extends substantially the width of aperture 31 within concentrator 30. The material is fed by wheels 19 at a slow enough speed so that it must flow in the direction of rotation, indicated by arrow 33, toward the downstream wall 32 of the concentrator. The electromagnetic force field between the wheel and the surface 34 acts to limit material flow. In addition, the strength of the magnetic field at the surface 34 determines the thickness of the strip.

The stages of solidification are illustrated in FIG. 3. The melt begins to solidify from the surface of the chill wheel upwards towards the concentrator because of the heat transfer from the melt into the chill wheel. If the heat transfer coefficient at the interface is such that the heat transfer is too efficient, the material will solidify prior to any shaping. On the other hand, if the heat transfer is too inefficient, the material will not completely solidify within the containment region and not form the desired shaped strip. The chill block may be cooled by any conventional means such as applying a coolant through a cooling manifold 45 to the surface of the chill block. It is also within the terms of the present invention to use any desired cooling means.

It is important that the top surface 48 of the ribbon 12 be at least partially solidified before the strip leaves the chill wheel. If this is not achieved under ambient conditions, it is within the scope of this invention to apply top cooling in any conventional manner such as, for example, applying a nonreactant cooling gas to the top surface 48 of the strip. The preferred embodiment has the solidification parameters selected whereby a solid shell is formed on the top and bottom of the strip just before it exits the electromagnetic containment zone.

An important consideration is the ability to form large grain material with the grains essentially normal to the casting direction (indicated by arrow 49). This may be achieved by having the solidification move in an upward direction away from the chill wheel towards the top surface 48. This allows the grains to grow from the bottom into the liquid. Further, it is desired that the growth rate be rather slow. This implies that the top of the melt must remain relatively molten in order that the grain growth can move upward. The top surface is conveniently heated by the electromagnetic field produced by the concentrator. The amount of heat applied at a given containment load may be controlled by varying frequency of the current applied to the inductor coil 28.

The selection of the frequency of the inductor current and its ability to define the dimensions of the strip as well as control the solidification rate is a critical aspect of the present invention and one which differentiates the present invention from the prior art. The method of using a chill wheel for solidifying a stream of melt into a thin ribbon, as applied in the present invention, is not conventional melt spinning. Melt spinning uses the momentum associated with casting speed and heat transfer from the ribbon to define the ribbon dimensions. By contrast, the present invention has a relatively low casting speed and does not use the wheel momentum to define the ribbon dimensions. Instead, the dimensions of the strip 12 are defined by the strength of the electromagnetic containment field. Note that the width of the strip may be substantially equal to the width of the wheel. Further, the electromagnetic energy is a primary control of the solidification rate. By choice of frequency, one may control the amount of heat being pumped into the strip and thereby vary the time required for the solidification of the melt. Basically, the effect of the electromagnetic field is distributed between the pressure which squeezes the molten material into the strip and the heat generated in the strip. By selecting the frequency of the inductor current and the thickness of the thin strip via power level and concentrator proximity, the ratio of squeezing pressure to heat generation may be controlled. Preferably, the strip thickness is such that all of the energy of the electromagnetic field is dissipated in the silicon strip. This prevents penetration of the energy into the wheel where it is directly dissipated.

The skin depth is represented by the following formula:

$$\delta = \sqrt{\frac{\rho}{\mu_o \pi f}}$$

where $\delta$=penetration depth, $\rho$=the electrical resistivity of material, $\mu_o$=the permeability of free space, the relative permeability $\mu_r$ of materials of interest being unity, f=frenquency of current and $\pi = \approx 3.14$. The penetration depth is the depth of material from the outer surface through which the current density has an approximate exponential decay of about 63% as compared to the current at the outer surface. Twice the penetration depth, i.e. $2\delta$, is the depth of material at which the current density has an approximate decay of about 86% as compared to the surface.

In practicing the present invention, the strip thickness is chosen to be about 1 and $4\delta$ and preferably about $2\delta$. If the skin depth is much less than $2\delta$, the strip will be partially transparent to the field. Power dissipation is complicated by the existance of the interface between the ribbon and the semi-infinite chill surface. Owing to the possible resistivity change between the melt and the wheel, there will be electromagnetic reflections at the interfaces that can lead to a local peak in the induced current and an associated sharp rise in the dissipated power. To prevent this heat management problem, the strip thickness may be chosen to prevent penetration of the electromagnetic field into the wheel or the resistivity of the melt may be matched with the resistivity of the wheel so as to prevent the generation of local peak currents. The thin strip of the present invention is preferably between about 0.1 to about 3 mm thick and more preferably between about 0.5 to about 1.0 mm thick.

Although silicon has been primarily described as the material of interest, the invention may be used for any metal, semi-metal, metalloid or especially hard refractory metals which are difficult to form into thin strip.

Besides the embodiment shown using a chill wheel 16, it is also within the terms of the present invention to use a different device such as an endless belt. Further, the concentrator may be of any desired shape and may be substituted for by any suitable device for creating an electromagnetic force field in the appropriate sense.

In practice, the exemplary operating parameters for the silicon casting system illustrated in FIG. 1 may be ascertained.

For the reasons mentioned above, to avoid significant power loss into the chill wheel, the ribbon thickness b, see FIG. 3, should be approximately twice the skin depth $\delta$. Taking $b \approx 2\delta$, the desired operating frequency f for the inductor current is given by:

$$f = \rho/\mu_o \pi \delta^2 = 4\rho/\mu_o \pi b^2$$

For silicon the resistivity $\rho$ is $80 \times 10^{-6}\ \Omega$cm. Choosing b=0.1 cm as an upper limit on ribbon thickness $$f = \frac{80 \times 10^{-6}\ \Omega \cdot \text{cm} \times 4}{4\pi \times 10^{-9}\ \Omega \cdot \text{sec} \cdot \text{cm}^{-1} \times \pi(0.1\ \text{cm})^2} = 8 \times 10^5\ \text{Hz}$$

Thinner ribbon could be produced by using higher frequencies. Using the above relationship, casting of 0.04 cm ribbon would require a frequency of 5 MHz.

Satisfactory control of shaping depends on the rate of solidification of the ribbon. Premature freezing of the melt in contact with the chill wheel prevents proper shaping while insufficient shell formation results in the relaxation of the ribbon geometry under the influence of surface forces on exiting from the current concentrator 30. The limits on acceptable solidification front position are shown schematically in FIG. 3. A solidification front sharper than AD, i.e. in the upstream direction, limits shaping capabilities while a shallow front AC must be sufficient to freeze a rigid shell of thickness CC' of, for example, 0.001 cm. The heat flow conditions for this arrangement indicate that speeds of about 20 cm./minute should be attainable in casting silicon ribbon with a thickness of 0.1 cm. This compares very favorably with the practical limit of 4 cm./minute achieved by ribbon casting apparatus now in commercial use. The present invention also has the additional advantage that fine control over the solidification conditions required to produce a quality single crystal product can be exercised by adjustments to both the casting speed, the ambient temperature of the chill surface and the provisions of any necessary seeding crystal.

Figure 4:
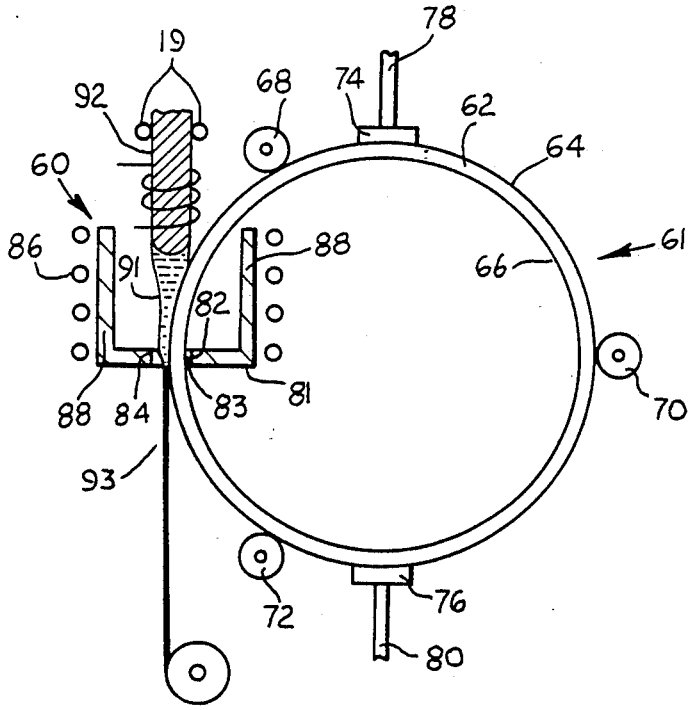
FIG. 4 is a schematic representation of a second embodiment of the present invention.

Referring to FIG. 4, there is indicated a second preferred embodiment of the present invention which primarily differs from the first embodiment of FIG. 1 in regards to the shape of the second flux concentrator 60 and the chill block 61. The chill block in this embodiment is preferably and generally described as a chill wheel 62. However, it is within the scope of the present invention for the chill block to comprise any moving structure, such as a movable circular or oval belt or a flat surface. The chill wheel is formed of a moving, circular frame structure having outer and inner surfaces 64 and 66, respectively. The chill wheel 62 is supported by three rotating wheels 68, 70 and 72. They are preferably located at approximately 120° apart from each other and contact the outer surface 64 of the chill wheel so as to rotate it at any desired speed. Additionally, these wheels may be used as surface wipers and/or substrate cooling points. Although three wheels are shown, it is also within the scope of the present invention to use any number of wheels as desired. Further, any other conventional means, such as wheels contacting inner surface 66, may be used to rotate the chill wheel. The chill wheel is cooled by any conventional means such as providing slip ring collars 74 and 76 at either end. The slip ring collars are affixed to the wheel so that the wheel 62 may rotate through them and allow a coolant to flow into the wheel through pipe 78 and out the wheel 62 through pipe 80. The chill wheel may be cooled by other conventional means such as directly applying a coolant to either surface of the chill wheel or by any other desired technique.

Figure 5:
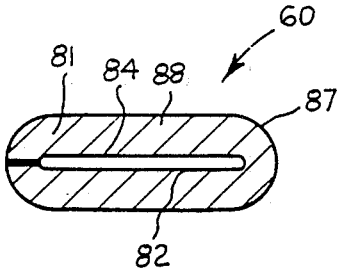
FIG. 5 is a cross-sectional view of the flux concentrator of FIG. 4.

The flux concentrator is preferably disposed on either side of the circular frame so that the chill wheel may rotate through the concentrator. The concentrator, as seen in cross section in FIG. 5, includes a base 81 having a substantially oval slot 83 therein. Two sides of the slot are inner surfaces 82 and 84 of base 81. These surfaces are generally disposed parallel and opposite to one another. A second inductor coil 86 is wound about the perimeter of the vertical wall 88 which extends longitudinally with the direction of casting from the base 81. The molten material 91 may be delivered onto the chill wheel from a feed rod 92. As with feed rod 14 of the first embodiment, the rod 92 may be heated to form the melt 91 by any conventional means such as inductive, radiative or irradiation. The molten material 91 contacts the surface 64 of wheel 62 and flows through the slot 83. As in the first embodiment of FIG. 1, the concentrator 60 concentrates the induced current from a seventh electromagnetic field generated by the second inductor coil 86 into the slot 83. The resulting sixth electromagnetic force field shapes the melt against the surface 64 of the wheel into the desired thin strip shape. The selection of the proper inductor frequency, solidification rate, and thickness of the final strip 93 may be determined in accordance with the description of their selection described with regards to the embodiment illustrated in FIG. 1.

Figure 6:
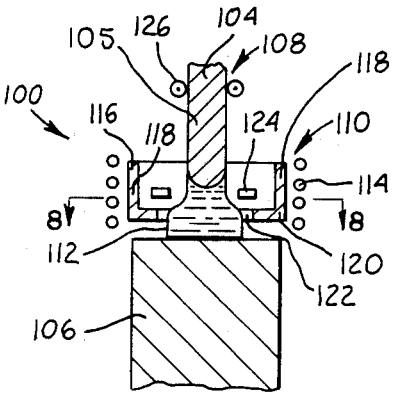
FIG. 6 is a schematic representation of a third embodiment of the present invention wherein the material feed is both melted and shaped prior to its contact with a chill wheel.
Figure 8:
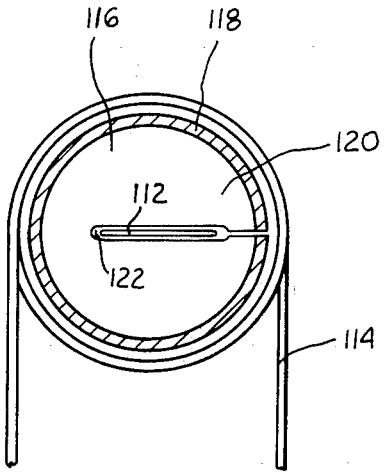
FIG. 8 is a view through 8—8 of FIG. 6.
Figure 7:
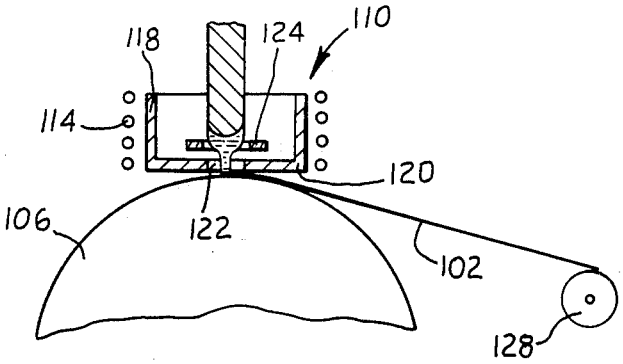
FIG. 7 is a side view of FIG. 6.

A third embodiment, as illustrated in FIGS. 6–8, is directed to shaping a pendant drop prior to its contact on a chill surface. The apparatus 100 of this embodiment produces a thin ribbon 102 of semiconductor material 104. A moving chill block 106 is disposed adjacent a feed device 108 which directs a solid bar 105 of material 104 towards the chill block. An electromagnetic generating device 110 heats the solid material into a molten pendant drop 112 and shapes this molten drop prior to its contact with the chill block.

There are several problems associated with the delivery of a molten metal, semimetal or semiconductor material onto a chill block surface for thin strip formation. The most critical of these are contamination of the melt from any containment apparatus, control of delivery shape and regulation of delivery rate. The third embodiment, illustrated in FIGS. 6–8, solves these problems with novel techniques for shaping and then feeding molten material onto a chill block. These techniques are particularly suited but not limited to high melting point and/or reactive materials and can be used both for slow casting processes as well as rapid quenching chill block techniques. Although semiconductor material such as silicon is the preferred material to be processed, it is with the scope of the present invention to use any metal, semi-metal or semiconductor material as desired. Referring to FIG. 6, the conventional chill block 106 may be formed of a variety of materials and surfaces depending on the specific application.

The apparatus of this embodiment employs a novel combination of high frequency induction melting and electromagnetic containment. As schematically illustrated in FIGS. 6–8, a feed stock bar 105 of material 104 is preferably melted by an inductor coil 114. Selection of the frequency for the induction heating is in accordance with the resistivity, surface tension and physical dimensions of the feed stock material 104. The feed stock is heated to generate a molten mass or pendant drop 112 below and connected to the solidified rod.

The pendant drop, as a melt source for slow melt extraction of wide, thin strip against the slowly moving substrate 106, delivers uncontaminated material onto the chill surface. The contact between the pendant drop and the chill block is illustrated in FIG. 6. The cross-sectional view through the strip and chill block indicates that the width of the molten drop 112 expands from the shape of the feed stock bar prior to contact with the surface of the chill block.

The electromagnetic field generating device 110 includes a third electromagnetic die or flux concentrator 116. The concentrator, as illustrated in FIGS. 6–8, includes a substantially circular side wall 118 extending upward, parallel to the direction of casting, from a base member 120 and longitudinal to the direction of casting. The wall defines the periphery of a material delivery and heating zone. An oval slot or aperture 122 within the base member 120 defines the shape and location of the maximum electromagnetic field generated by the concentrator. As described hereinabove regarding the flux concentrator 60, a third RF inductor coil 114 is disposed about the outer circumference of wall 118. A current iduced in the wall by the second electromagnetic field from the coil is concentrated about the perimeter of slot 122. The resulting first electromagnetic force field within the slot shapes the pendant drop 112 into the desired shape prior to application on chill wheel 106. The full width of the pendant drop may be applied to the wheel 106 after it has been thinned down by the electromagnetic field as illustrated in FIG. 6. Preferably, the pendant drop is thinned down to a strip having a thickness of between about 1 to about 10 mm and more preferably between about 2 to about 5 mm. The shape of the slot determines the shape of the pendant drop. It is in accordance with the present invention to shape the slot as desired to shape the molten material as required.

The first electromagnetic field may be stabilized by the addition of a conventional bucking ring 124 within the delivery and heating zone. The bucking ring reduces the interaction between the electromagnetic field generated in the slot with the molten material upstream of the ring. It is within the scope of the present invention to modify the shape of the bucking ring or add any number of bucking rings so as to contour the electromagnetic field as desired.

Referring to FIG. 6, the feed device 108 may comprise any conventional means, such as two or more rollers or wheels 126 for feeding the strip 105 towards the chill block 106. The speed of the rollers may be varied to match the desired casting speed and thereby conveniently produce a continuous strip 102 of the desired width and thickness. The thin continuous strip 102 may then be coiled onto a reel 128 or collected in any other desired manner.

In operation, a solid feed stock of material 104 is fed towards the chill wheel 106 by the rollers 126. As the feed stock enters the concentrator 116, it can be heated to the molten state and reside in the first electromagnetic field as a contained molten pendant drop. At this point, the heat content of the pendant drop can be modulated by frequency changes without alteration of containment. As described in the first embodiment, if necessary the feed stock may be initially heated by such means as a heating coil about the feed stock with or without a susceptor, resistive heating or a directed energy source. The current induced in the flux concentrator 116 flows in its walls and is concentrated about the slot 122. The induced current generates a first electromagnetic field which is concentrated within the slot and whose primary interaction with the molten drop is in the slot. The electromagnetic field squeezes the molten material into a width corresponding to the width of the slot and with a desired thickness. As described above, the energy within the electromagnetic field is distributed between the pressure which squeezes the molten material into the strip and the latent heat pumped into the strip. By selecting the frequency of the inductor current and the thickness of the thin strip, the ratio of squeezing pressure to latent heat addition may be controlled. The strip of molten material is cast onto the surface of chill block 106. It can be appreciated that the shaped melt is deposited onto the chill surface in an uncontaminated condition. Further, the full pendant drop is utilized and the process proceeds more quickly and efficiently. The shaped metal can be solidified into the desired shape without any additional operations. The casting rate preferable proceeds at about 10 to about 30 cm/min and more preferably at about 15 to about 25 cm/min. However, it is within the scope of the present invention for any casting rate selected in accordance with the solidification requirements of the final strip. As in conventional rapid quenching casting, the rate of solidification may be controlled by cooling the chill block and/or directing a coolant onto the solidifying strip.

In an additional embodiment shown in FIG. 9, independent heating of the feed stock and independent containment of the molten pendant drop are provided. A feed stock bar 150 of material 104 may be melted by a fifth electromagnetic field generated by a fifth inductor coil 152 carrying a current of any desired frequency which is particularly suitable for melting the feed stock. A fourth containment inductor coil 154 for generating a third electromagnetic force field may be disposed about a fourth electromagnetic flux concentrator 156 having a slot 158 of any desired shape. A current is induced and concentrated in the fourth concentrator so as to generate the fourth electromagnetic field for shaping the molten drop of material onto the thin ribbon shape. The slot 158 is preferably shaped in an oval configuration similar to the slot 122 illustrated in FIG. 8.

After the molten material has been shaped into the desired width and thickness by fourth electromagnetic field generated within the slot 158 by an induced current in the concentrator 156 from a fifth electromagnetic force field generated by the inductor 154, it is deposited onto the surface of a chill wheel 160 where it is solidified into a strip or ribbon 162 by any conventional manner. For instance, the chill wheel may be cooled and/or a coolant may be applied to the strip. One particular advantage of the embodiment shown in FIG. 9 is that independent control of melt temperature is possible. The structure of the solidified strip 162 is critically dependent on solidification conditions. For example, high quality silicon ribbon for solar cell applications necessitates high purity large grain or single crystal material. The local presence of the containment field provides an extra control, by way of heating, of the solidification and growth phenomena in the ribbon.

Another embodiment, as shown in FIG. 10, is directed to the combination of a device 170 for melting a feed stock 172 of material 104 into a pendant drop 174, shaping the pendant drop into a thin strip shape prior to the contact with the surface of a chill block 176, and a device 178 for electromagnetically shaping the molten thin strip into the final desired width and thickness. The device 170 is comprised of an apparatus which is substantially the same as the embodiment illustrated in FIGS. 6–8. The device 178 is substantially the same as the electromagnetic shaping apparatus of the embodiment illustrated in FIGS. 4 and 5 described hereinabove. The operating principles of both devices 170 and 178 are substantially the same as the embodiments to which they are similar. The advantage of combining the shaping of the pendant drop prior to contact with the chill block and the shaping of the strip that has been deposited onto the chill block is that extra fine control of both the solidification and shape of the final strip may be achieved.

The patents and patent applications set forth in this application are intended to be incorporated by reference herein.

It is apparent that there has been provided in accordance with this invention a chill block with an electromagnetic field associated therewith and a method for using this apparatus for forming molten material into thin strip which fully satisfy the objections, means, and advantages set forth hereinabove. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An apparatus for producing a thin ribbon of material, comprising:

a moving chill block;

means adjacent said chill block for feeding said material onto said chill block; and means associated with the feed means for generating a first electromagnetic field to heat said material in the solid condition into a molten drop and to shape said molten drop into a thin ribbon shape prior to contact of said molten material with said chill block.

2. The apparatus of claim 1 wherein said first electromagnetic field generating means includes a third inductor for generating a second electromagnetic field.

3. The apparatus of claim 2 wherein said first magnetic field generating means further comprises a third flux concentrator disposed within the second electromagnetic field whereby a current is induced and concentrated in the concentrator so as to generate the first electromagnetic field for shaping the molten drop of material into said thin ribbon shape.

4. The apparatus of claim 3 wherein said third concentrator comprises a base member with slot means therein; and a side wall disposed about the edge of said base member and extending upward from the base member and longitudinal to the direction of casting, said side wall defining a material delivery and heating zone.

5. The apparatus of claim 4 wherein said slot means within said third concentrator is shaped for forming said molten drop into the desired thin ribbon shape prior to the molten material contacting said chill block.

6. The apparatus of claim 5 wherein said slot means has an oval shape.

7. The apparatus as in claim 5 wherein a portion of said first electromagnetic field disposed within the heating zone defined by said side wall heats said material in the solid condition.

8. The apparatus as in claim 7 further including bucking ring means disposed within the heating zone defined by said side wall adjacent said slot for reducing the interaction of said first electromagnetic field on said molten drop upstream of said bucking ring means.

9. The apparatus of claim 8 further including coiling means for pulling the solidified thin ribbon from said chill wheel.

10. An apparatus for producing a thin ribbon of semiconductor material, comprising:

a moving chill block;

means adjacent said chill block for feeding said semiconductor material onto said chill block; and means associated with the feed means for generating a first electromagnetic field to heat said material in the solid condition into a molten drop and to shape said molten drop into a thin ribbon shape prior to contact of said molten semiconductor material with said chill block.

11. The apparatus of claim 10 wherein said first electromagnetic field generating means includes a third inductor for generating a second electromagnetic field.

12. The apparatus of claim 11 wherein said first magnetic field generating means further comprises a third flux concentrator disposed within the second electromagnetic field whereby a current is induced and concentrated in the concentrator so as to generate the first electromagnetic field for shaping the molten drop of material into said thin ribbon shape.

13. The apparatus of claim 12 wherein said third concentrator comprises a base member with slot means therein; and a side wall disposed about the edge of said base member and extending upward from the base member parallel to the direction of casting, said side wall defining a material delivery and heating zone.

14. The apparatus of claim 13 wherein said slot means is shaped for forming said molten drop into the desired thin ribbon shape prior to the molten semiconductor material contacting said chill block.

15. The apparatus as in claim 14 wherein a portion of said first electromagnetic field disposed with the heating zone defined by said side wall heats said semiconductor material in the solid condition.

16. The apparatus as in claim 15 further including bucking ring means disposed within the heating zone defined by said side wall adjacent said slot for reducing the effect of said first electromagnetic field on said molten drop upstream of said bucking ring means.

17. An apparatus for producing a thin ribbon of material, comprising:

a moving chill block;

means adjacent said chill block for feeding said material onto said chill block;

means associated with the feed means for generating a fifth electromagnetic field to heat said material in the solid condition into a molten drop; and means adjacent said chill block for generating a fourth electromagnetic field to shape said molten drop into a thin ribbon shape prior to contact of said molten material with said chill block.

18. The apparatus of claim 17 wherein said means for generating a fifth electromagnetic field comprises a fifth inductor disposed about said material in the solid condition.

19. The apparatus of claim 18 wherein said means for generating a fourth electromagnetic field comprises a fourth inductor adjacent said chill block generating a third electromagnetic force field; and a fourth flux concentrator disposed within said third electromagnetic field whereby a current is induced and concentrated in the concentrator so as to generate the fourth electromagnetic field for shaping the molten drop of material into said thin ribbon shape.

20. The apparatus of claim 19 wherein said fourth concentrator comprises a base member with a slot means therein whereby said fourth electromagnetic field is concentrated within said slot.

21. An apparatus for producing a thin ribbon of material, comprising:

a moving chill block;

means disposed adjacent said chill block for feeding said material onto said chill block;

means associated with the feed means for generating a first electromagnetic field to heat said material in the solid condition into a molten drop and to shape said molten drop into a thin ribbon shape prior to contact of said molten material with said chill block; and means adjacent said chill block for generating a sixth electromagnetic field to apply pressure to the molten material to squeeze the deposited molten material on said chill block into said thin ribbon of material.

22. The apparatus of claim 21 wherein the first electromagnetic field generating means includes a third inductor for generating a second electromagnetic field; and the sixth electromagnetic field generating means includes a second inductor for generating a seventh electromagnetic field.

23. The apparatus as in claim 22 wherein said first electromagnetic field generating means further comprises a third flux concentrator disposed within the second electromagnetic field whereby a current is induced and concentrated in the third concentrator so as to generate the first electromagnetic field for shaping the molten material into molten thin ribbon.

24. The apparatus of claim 23 wherein said sixth magnetic field generating means further comprises a second flux concentrator disposed within the seventh electromagnetic field whereby a current is induced and concentrated in the second concentrator so as to generate the sixth electromagnetic field for squeezing the molten drop of material against said chill block into said thin ribbon shape.

25. The apparatus as in claim 24 wherein said chill block comprises a moving frame; and said second flux concentrator comprises a base member with a slot therein, said base member being disposed substantially transverse to the direction of casting to allow said frame to move through said slot.

26. The apparatus as in claim 25 wherein said induced current is concentrated about the slot causing said sixth electromagnetic field to be concentrated within said slot so that said molten material passing said slot is squeezed against the surface of said chill block and formed into said desired thin ribbon.

27. The apparatus as in claim 26 wherein said third concentrator comprises a second base member with a second slot therein; and a side wall disposed about the edge of said second base member and extending upward from the base member parallel to the direction of the material being fed onto the chill block.

28. The apparatus of claim 27 wherein said second slot is shaped for forming said molten drop into the desired thin ribbon shape prior to the molten material contacting said chill block.

29. The process of producing a thin ribbon of material comprising the steps of:

providing a moving chill block;

feeding said material in the molten condition onto said chill block; and generating a first electromagnetic field to heat the material in the solid condition into a molten drop and to shape the molten drop into a thin ribbon shape prior to contact of the molten material with the chill block.

30. The process as in claim 29 further including the step of providing a third inductor for generating a second electromagnetic field.

31. The process of claim 30 further including the step of disposing a third flux concentrator within the second electromagnetic field whereby a current is induced and concentrated in the concentrator so as to generate the first electromagnetic field for shaping the molten drop of material into said thin ribbon shape.

32. The process as in claim 31 further including the step of heating the material into the molten state.

33. The process as in claim 31 including the step of selecting said molten material from the group consisting of metals, semi-metals and semiconductors.

34. The process as in claim 33 including the step of selecting said molten material from silicon material.

35. The process as in claim 33 further comprising the step of generating a sixth electromagnetic field to apply pressure to molten material to squeeze the deposited molten material on said chill block into said thin ribbon of material.

36. The process of producing a thin ribbon of material comprising the steps of:

providing a moving chill block;

generating a fifth electromagnetic field to heat said material in the solid condition into a molten drop;

generating a fourth electromagnetic field to shape said molten drop into a thin ribbon shape of molten material prior to contact of said thin ribbon of said molten material with said chill block; and feeding said material onto said chill block.

37. The process of claim 36 wherein said step of generating a fifth electromagnetic field includes providing a fifth inductor disposed about the material in the solid condition.

38. The process as in claim 37 wherein said step of generating a fifth electromagnetic field comprises the steps of:

providing a fourth inductor adjacent said chill block generating a third electromagnetic force field; and providing a flux concentrator disposed within the third electromagnetic field whereby a current is induced and concentrated in the concentrator so as to generate the fourth electromagnetic field for shaping the molten drop of material into said thin ribbon shape.

* * * * *